United States Patent [19]

Tokunaga et al.

[11] 3,997,371

[45] Dec. 14, 1976

[54] PERMANENT MAGNET

[75] Inventors: Masaaki Tokunaga, Kumagaya; Kazuo Yamakawa, Hoya, both of Japan

[73] Assignee: Hitachi Metals, Ltd., Japan

[22] Filed: Nov. 4, 1974

[21] Appl. No.: 520,904

[30] Foreign Application Priority Data

Nov. 12, 1973 Japan ..... 48-126250

[52] U.S. Cl. ..... 148/31.57; 75/152; 148/103; 148/105

[51] Int. Cl.[2] ..... H01F 1/04

[58] Field of Search ..... 148/31.57, 101, 103, 148/105; 75/152

[56] References Cited

UNITED STATES PATENTS

| | | | |
|---|---|---|---|
| 3,424,578 | 1/1969 | Strnat et al. | 148/103 |
| 3,546,030 | 12/1970 | Buschow et al. | 148/31.57 |
| 3,655,463 | 4/1972 | Benz | 148/101 |
| 3,682,714 | 8/1972 | Martin et al. | 148/31.57 |
| 3,682,716 | 8/1972 | Martin et al. | 148/31.57 |
| 3,684,591 | 8/1972 | Martin et al. | 148/31.57 |
| 3,901,741 | 8/1975 | Benz et al. | 148/31.57 |

FOREIGN PATENTS OR APPLICATIONS

| | | | |
|---|---|---|---|
| 2,219,481 | 7/1973 | Germany | 148/31.57 |

OTHER PUBLICATIONS

Strnat, K; *Co–Re Alloys as Perm. Mag. Materials*, in *Cobalt*, 36, Sept. 1967, p. 137 (compositions of mesh-metals).

Velge, W., et al; *Perm. Mag. Prop. of Rare Earth Cobalt Compounds*, in *I.E.E.E. Trans. Mag.* Mar. 1967 pp. 45–48.

Nesbitt, E., et al; *Cast Perm. Mag.* $Co_5Re$ Type with Mixtures of Cerium & Samarium, in *J. Appl. Phys.*, 42, Mar. 1971.

Buschow, K., et al; *Perm. Mag. Mtl's of Rare–Earth Cobalt Compounds*, in *Zeit. Fur Ange. Physik*, 26, 1969 pp. 157–160.

*Primary Examiner*—Walter R. Satterfield

*Attorney, Agent, or Firm*—Craig & Antonelli

[57] ABSTRACT

A permanent magnet made of a sintered product consisting essentially of a cobalt-samarium-heavy rare earth elements alloy having a lower reversible magnetization temperature coefficient than that of a cobalt-samarium alloy.

18 Claims, 2 Drawing Figures

PERMANENT MAGNET

Figure 1:
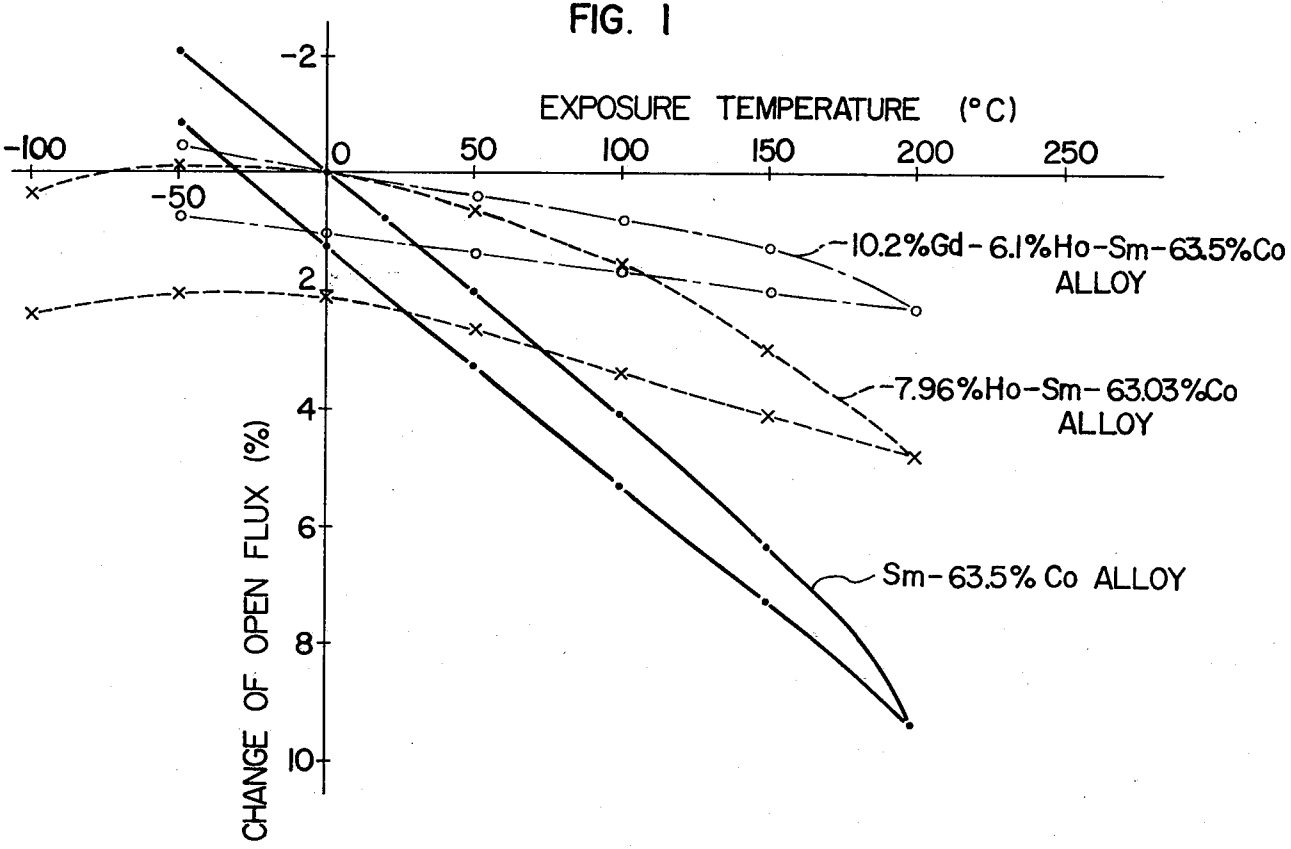

This invention relates to a permanent magnet consisting of rare earth elements and cobalt, and more particularly to a permanent magnet presenting an improved temperature-dependent characteristic for its magnetic characteristics.

The intermetallic compounds $RCo_5$, $R_2Co_{17}$ and $R_2Co_7$ found in a phase diagram of R and Co are considered to be of promise as alloy elements for use as materials for permanent magnets, wherein "R" is a combination of one or more kinds of rare earth elements selected from a group consisting of Sm, Pr, Ce, and La. However, in the practical use, alloys having the mixture of those metallic compounds (this alloy structure is so called composite structure), whose compositions are ranging from $R_2Co_7$ to $R_2Co_{17}$ including $RCo_5$, exhibit excellent magnetic characteristics.

Various studies have been made concerning with permanent magnetic alloys consisting of rare earth elements and cobalt. In publications, those known as employable for this purpose among the rare earth elements are Y, Sc and lanthanide elements in the range of 57 to 71 atomic numbers such as La, Ce, Pr, Nd, Pm, Sm, Eu, Gd, Tb, Dv, Ho, Er, Tm, Yb and Lu. However, in such publications even unpractical elements such as for example Pm which does not exist naturally are described to be usable, and there are no experimental data for practical use. Reported as practicable elements for permanent magnet alloys are only the light rare earth elements of the rare earth elements, such as alloys containing cobalt, La, Ce, Pr, Sm and Ce mischmital consisting essentially of Ce, while little has been reported on the characteristics of alloy consisting of transition metal and heavy rare earth elements covering a range from Eu to Lu, when used as materials for permanent magnets, although there has been studied the magnetic properties of alloys consisting of those elements.

Hitherto, the permanent magnet alloys consisting of light rare earth elements, La, Ce, Pr, Sm and Co are found to present a high residual magnetic flux density Br and high coercive force BHc and IHc, and there is obtained an amazingly excellent maximum energy product (BH) max. as high as 23 to 26 MGOe, which is more than twice the value obtained from conventional cast magnetic alloy of 11 MGOe of Alnico 9. Because of such an excellent permanent magnetic characteristic, the aforesaid permanent magnets consisting of light rare earth elements are used for equipments in which there are required intensive magnetic field and small size.

However, as can be seen from Table 1, the temperature characteristic of such a permanent magnet is not satisfactory and, particularly, the reversible temperature range thereof is more than twice that of an Alnico permanent magnets. On the other hand, it is a general procedure that such a permanent magnet is once heated up to about 250° C prior to the use thereof so as to get the so-called "stabilization" to achieve 5 % demagnetization.

For this reason, it is difficult to use those permanent magnets in the environment, in which a large temperature change occurs the excellent magnetic characteristics thereof is not utilized sufficiently in such environment.

Table 1

Temperature characteristics of permanent magnets

| Alloy | Permeance | Reversible Temperature coefficient of magnetic flux (%/° C) |
|---|---|---|
| Alnico 3 | 3 | −0.022 |
| Alnico 5 | 4 | −0.016 |
| Ba ferrite | 0.5 | −0.19 |
| Sm-Co | 1 | −0.03 to −0.07 |

It is accordingly an object of the present invention to provide a permanent magnet whose magnetic characteristics is less dependent on such a temperature change, i.e., the permanent magnet whose magnetic characteristics, particularly, the magnetic flux is least affected by the temperature change.

The present invention is directed to improving the temperature dependent characteristic of a permanent magnet by providing a permanent magnet consisting of light rare earth elements whose composition range covering $R_2Co_7$ to $R_2Co_{17}$, with some parts of light rare earth elements being substituted by heavy rare earth elements.

Figure 2:
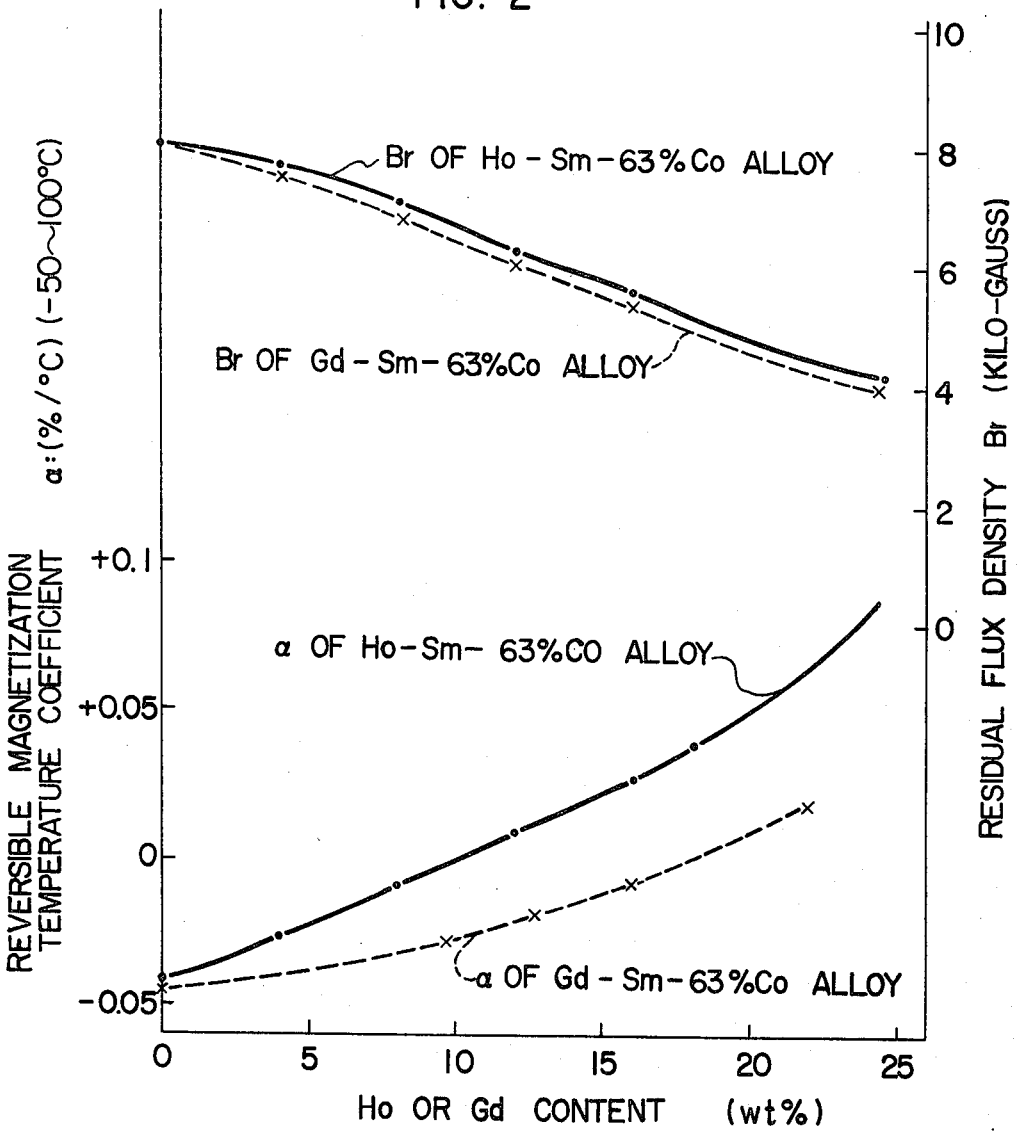

FIG. 1 is a plot showing the change of open flux with exposure temperature for Sm-Co alloy, Sm-Ho-Co alloy and Sm-Ho-Gd-Co alloy, and FIG. 2 shows the variation of Br and a with the content of Ho and Gd. For Ho-Sm-Co and Gd-Sm-Co alloys.

The amount of R in the composition range of $R_2Co_7$ and $R_2Co_{17}$ should be between 43 and 23 % (by weight), while the balance is essentially Co. The light rare earth element exhibiting the most excellent magnetic properties as a permanent magnet is Sm, while the substitution of a part of Sm by Pr presents a higher residual induction. In addition, when a part of Sm is substituted by Ce or Ce alloys, i.e., Ce mischmetal, then there will be obtained less expensive permanent magnet, without accompanying deterioration in the characteristics as a permanent magnet. Accordingly, alloys according to the present invention contain Pr, Ce or Ce mischmetal in addition to Sm which serves as a base element.

It was found that a permanent magnet having desired properties can be obtained when part of light rare earth elements of 23 to 43 % by weight are substituted by one or more elements selected from the group consisting of Ho, Er, Dy and Tb which are heavy rare earth elements. The reversible magnetization temperature coefficient $\alpha$ of a rare earth-cobalt permanent magnet becomes to be lower than 0.03 % in its absolute value in the temperature range from −50° to 100° C, when some parts of the light rare earth elements are substituted by one or more elements of Ho, Er, Dy and Tb. In addition, when Ce or Ce mischmetal is contained as light rare earth elements, the value $|\alpha|$ becomes to be lower than 0.04 %/° C in the temperature range of −50° C to 100° C. The reversible magnetization temperature coefficient as used in the specification and drawings of the present invention is defined as follows:

Assume the magnetic flux $\Phi a$(Maxwell) of a permanent magnet at a temperature of $Ta$° C and the magnetic flux $\Phi b$ (Maxwell) of a permanent magnet at a temperature of $Tb$° C, then the change in magnetic flux $\Delta\Phi = \Phi a - \Phi b$, and the variaton in temperature $\Delta T = Ta - Tb$.

Thus, the reversible magnetic temperature coefficient $\alpha$ in the temperature range of T$a$° C to T$b$° C will be given as follows:

$$\alpha = \frac{\Delta \Phi}{\Phi a} \times 100 / T \ (\%/° \text{C}).$$

The addition of Gd to the composition of the permanent magnet of the present invention consisting of one or more element of Ho, Er, Dy and Tb, brings about a further improved temperature characteristic. The addition of Gd gives a tendency to enhance the lineality for the temperature dependent characteristic thereof. This then lessens the temperature coefficient over the wide range of temperatures, presenting the absolute value $\alpha$ of no more than 0.02 %/° C in the temperature range of −50° to 200° C, or 0.03 %/° C even in the case of Ce being contained. In case the permanent magnet contains Ho or Er, the temperature characteristic at a relatively low temperature near room temperature is improved, while in the case of Dy or Tb being contained, the temperature characteristic at a relatively high temperature may be improved.

Comparing a case of the Ho containing permanent magnet with another case of the permanent magnet containing Er, Dy or Tb, the magnetic characteristic of the Ho containing permanent magnet is superior at room temperature and is particularly superior with respect to the energy product (BH) max.

The heavy rare earth elements may be contained either in a unitary form or in a composite form in the permanent magnet alloy consisting of rare earth elements and cobalt.

The content of Ho should preferably be contained in the range from 3 to 18 % in the permanent magnet alloy essentially consisting of rare earth elements and cobalt. This is because, as will be described with reference to examples hereinafter, the content of Ho of not more than 3 % presents little improvements in the temperature characteristic, while the content of Ho of not less than 18 % results in lowered residual magnetic flux density.

Er should present in amount in the range of 2 to 17 %, Dy in the range of 2 to 15 %, and Tb in the range of 2 to 15 %. If the contents of the respective elements are not more than the lower limit, no improvement is made in the temperature characteristic, while the content of not less than the upper limit lowers the magnetic characteristic to a great extent.

In case part of Sm is substituted by Pr, the range of Pr should cover between 4 and 33 %. The content of Pr of not more than 4 % beings about no advantage or effect. On the other hand, the Pr content of not less than 33 % incurs deterioration on the magnetic characteristic.

In case part of Sm is substituted by Ce, the range of the Ce content should cover from 1 to 34 %. The addition of Ce of not more than 1 % does not bring about any advantages thereof. The cost of starting materials is lowered, with the increase in Ce content, while the magnetic characteristics are impaired, and in case the content of Ce is not less than 34 %, the permanent magnet is no longer practicable for use.

Alternatively, a part of cobalt content in the permanent magnet according to the present invention may be substituted by transition metal(s) selected from a group consisting of Ni, Fe, Cu, Mn and etc. while Si, Ca, Al or Zr may be added to the composition of an alloy. In this case, 20 % of Ca may be substituted by Cu or 10 % of Co may be substituted by Fe and/or Mn, resulting in no adverse influence on the advantages of the present invention.

If the inventive permanent magnet contains gadolinium, the amount thereof should be 3 to 20 %.

The permanent magnet consisting of rare earth elements and cobalt plus heavy rare earth elements according to the present invention presents least change in magnetic flux with temperature ranging from a relatively low temperature to 200° C.

The following examples are illustrative of the features of the present invention.

EXAMPLE 1

An alloy consisting of 29.01 % Sm, 7.96 % Ho and 63.03 % Co was prepared by arc melting. The alloy thus prepared was crushed to fine powders of an average particle size of 3.8 $\mu$. The powders were pressed axially under a pressure of 10 tons/cm$^2$ in the magnetic field of 8 Koe, thus giving a green body of the dimensions of 10 mm in dia. ×7 mm in length. The green body was sintered for 1 hour at 1180° C in the Ar atmosphere then cooled to 900° C at a cooling rate of 2° C/min, and quenched by blasting with Ar gas.

The magnetic characteristics of the sintered product and density were as below:

| | |
|---|---|
| Br | 7120 gauss |
| bHC | 6870 oersted |
| IHc > | 25000 oersted |
| (BH)max | 12.67 × 10$^6$ gauss oersted |
| Sintered density $\rho$ | 8.5 g/cm$^3$ |

The temperature characteristics are given as follows, when heated from the room temperature to 200° C anc cooled to the room temperature.

| | |
|---|---|
| Irreversible loss | 2.5 % |

The temperature coefficient of magnetic flux is given as follows:

$\alpha = 0$ %/° C (−90° C − 0° C)
$\alpha = 0.013$ %/° C (0° C − 200° C)

Meanwhile, $\alpha = -0.010$ %/° C in the range of −50° to 100° C.

The aforesaid measurements were carried out at a permeance coefficient of 2.

On the other hand, an alloy consisting of 37 % Sm and 63 % Co was prepared by arc melting and then processed in the same manner as has been described in the previous example to give a sintered product. The magnetic characteristics of the sintered product obtained were as follows:

| | |
|---|---|
| Br | 8000 G |
| BHC | 8000 Oe |
| IHc | 25000 Oe |
| (BH)max | 16 MG Oe |

The temperature characteristic of the sintered product ($R_1$T. − 200° C) was as below:

| | |
|---|---|
| Irreversible loss | 1.3 % |
| Temperature coefficient of magnetic flux | 0.04 %/° C |

FIG. 1 shows the temperature characteristic of the permanent magnet made of Sm-Co alloy and Sm-Ho-Co alloy as well as Sm-Ho-Gd-Co alloy. As is apparent from the aforesaid description and FIG. 1, the alloy containing Ho according to the present invention presents least reversible change, providing an excellent temperature characteristic.

The alloy containing Gd in addition to Sm, Ho and Co presents good linearity to the temperature coefficient over a wide range of temperature.

EXAMPLE 2

Alloy consisting of 32.75 % Sm, 3.99 % Ho, and 63.26 % Co was prepared by arc melting and then crushed to fine powders. The powders were then pressed axially under a pressure of 10 tons/cm$^3$ in the magnetic field of 8 KOe. The green body thus prepared was sintered for one hour at 1180° C in the Ar atmosphere, cooled to 900° C at a cooling rate of 2° C/min, and then quenched in Ar atmosphere.

The magnetic characteristics of the sintered product were as follows:

| | | |
|---|---|---|
| Br | | 7730 Gauss |
| BHc | | 7470 Oersted |
| IHc | > | 25000 Oersted |
| (BH)max | | 14.82 × 10$^6$ Gauss oersted |

The temperature characteristic thereof, when heated up to 200° C was as below:

| | |
|---|---|
| Irreversible loss | 3.6 % |

The temperature coefficient $\alpha$ of magnetic flux was as below:

$\alpha = -0.0250$ %/° C (−80° C − 100° C)
$\alpha = -0.0337$ %/° C (100° C − 190° C)

Meanwhile, the aforesaid measurements were carried out at a permeance coefficient of 2.

EXAMPLE 3

An alloy consisting of 21.61 % Sm, 15.80 % Ho and 62.59 % Co was processed in the same manner as described in the previous examples to obtain a sintered product.

The magnetic characteristic of the sintered product obtained were as follows:

| | | |
|---|---|---|
| Br | | 5640 Gauss |
| BHc | | 5050 Oersted |
| IHc | > | 25000 Oersted |
| (BH)max | | 7.84 × 10$^6$ Gauss oersted |

The temperature characteristic of the sintered product, when heated up to 200° C was as below.

| | |
|---|---|
| Irreversible loss | 1.53 % |

The temperature coefficient $\alpha$ of magnetic flux was:

$\alpha = +0.0570$ %/° C (−80° − −25° C)
$\alpha = +0.0253$ %/° C (−25° − 60° C)
$\alpha = +0.0051$ %/° C (60° − 120° C)
$\alpha = -0.0191$ %/° C (120° − 250° C)

$\alpha$ was obtained in the range of −50° to 100° C was found to be +0.026 %. Meanwhile, the aforesaid measurements were carried out at a permeance coefficient of 2.

EXAMPLE 4

An alloy consisting of 10.8 % Sm, 16.3 % Pr, 10.1 % Ho and 62.8 % Co was processed in the same manner as in the Example 1 to give a sintered body.

The magnetic characteristics thereof were as follows:

| | |
|---|---|
| Br | 7400 Gauss |
| BHc | 7300 Oersted |
| IHc | 20000 Oersted |
| (BH)max | 12.2 × 10$^6$ Gauss oersted |

The temperature characteristics of the sintered body, when heated up to 200° C, was:

| | |
|---|---|
| Irreversible loss | 5.0 % |
| The temperature coefficient $\alpha$ of the magnetic flux | 0.009 %/° C (−50° - 100° C) |

EXAMPLE 5

An alloy consisting of 13.6 Sm, 13.9 % Ce misch metal, 9.5 % Ho and 63 % Co was processed in the same manner as in Example 1 to give a sintered product.

The magnetic characteristics of the sintered product thus obtained were as follows:

| | |
|---|---|
| Br | 6600 Gauss |
| BHo | 6600 Oersted |
| IHc | 20000 Oersted |
| (BH)max | 10.9 MG Oe |
| Irreversible loss | 5.2 % (25° - 200° C) |
| $\alpha$ | −0.031 %/° C (−50 - 100° C) |

The temperature characteristic shown above is inferior to those shown in the other examples. This is because of the addition of Ce misch shown in metal as a light rare earth element in addition to Sm. However, this presents an excellent temperature characteristic as compared with the irreversible loss of 6 % and $\alpha$ of −0.060 %/° C of a permanent magnet consisting of 22.3 Sm −14.7 Ce −63.0 Co. This is due to the presence of Ho.

EXAMPLE 6

FIG. 2 shows the variation of temperature coefficient of the magnetic flux in the temperature range of −50° to 100° C and the residual magnetic flux densities (Br) at the room temperature with Ho and Gd content, with the amount of Co being maintained constant for, in Sm-Ho-Co system alloy and Sm-Gd-Co system alloy. As shown, in case the Ho and Gd content are increased, Br will decrease gradually. On the other hand, the absolute value of $\alpha$ gradually decreases, for instance, to −0.03 % in case Ho content is over 3 %, and to zero in case Ho content is 10.1 %. On the other hand, in case Gd is added, the absolute value of $\alpha$ will be zero in case Gd content is 18 %.

Comparing a Sm-Ho-Co alloy with a Sm-Gd-Co alloy, the residual magnetic flux densities at the composition which gives the zero temperature coefficient $\alpha$ are found to be 6700 Gauss and 5300 Gauss, respectively, which corresponds to $11.5 \times 10^6$ Gauss oersted and $7.1 \times 10^6$ Gauss oersted in the terms of the energy product, respectively. As can be seen from this, the permanent magnet containing Ho gives the magnetic characteristics superior to those of a permanent magnet of a Sm-Gd-Co alloy, thus presenting advantages in industries.

The aforesaid examples refer to a permanent magnet containing Ho. However, as shown in Table 2, it can been seen that the other heavy rare earth elements Er, Dy and Td improves the temperature characteristic in the same manner.

Table 2

| Alloy (wt.%) | Irreversible loss (0° - 200° C) (%) | Reversible mag. temp. coefficient (%/° C) (−50 - 100° C) | Energy product (BH)max ($\times 10^6$ GOe) |
|---|---|---|---|
| Sm −63.0 Co (Conventional magnet) | 1.3 | −0.04 | 16.0 |
| Sm −8.0 Ho −63.0 Co | 2.1 | −0.010 | 12.7 |
| Sm −7.7 Dy −63.2 Co | 2.6 | −0.017 | 11.5 |
| Sm −7.5 Tb −63.0 Co | 3.4 | −0.009 | 11.3 |
| Sm −7.8 Er −63.0 Co | 2.5 | −0.015 | 11.9 |
| Sm −10.2 Gd −6.1 Ho −63.5 Co | 1.0 | −0.006 | 10.2 |
| Sm −11.0 Gd −6.0 Dy −63.0 Co | 1.1 | −0.005 | 9.3 |
| Sm −11.1 Gd −4.1 Tb −63.0 Co | 1.4 | −0.008 | 9.1 |
| Sm −10 Gd −5.5 Er −62.8 Co | 1.9 | −0.008 | 9.7 |

What is claimed is:

1. A permanent magnet made of a sintered product consisting essentially of, in weight percent, (a) at least one of 3 to 18% Ho, 2 to 17% Er, 2 to 15% Dy and 2 to 15% Tb, (b) Sm, and (c) the balance consisting essentially of Co, wherein the amount of Sm is such that the total amount of rare earth elements including Sm in said product is 23 to 43%, and the absolute value of the reversible magnetization temperature coefficient of said sintered product is not more than 0.03%/° C in the temperature range of from −50° C to 100° C.

2. A permanent magnet made of a sintered product consisting essentially of, in weight percent, (a) at least one of 3 to 18% Ho, 2 to 17% Er, 2 to 15% Dy and 2 to 15% Tb, (b) 4 to 33% Pr, (c) Sm, and (d) the balance consisting essentially of Co, wherein the amount of Sm is such that the total amount of rare earth elements including Sm in said product is 23 to 43%, and the absolute value of the reversible magnetization temperature coefficient of said sintered product is not more than 0.03%/° C in the temperature range of −50° C to 100° C.

3. A permanent magnet made of a sintered product consisting essentially of, in weight percent, (a) at least one of 3 to 18% Ho, 2 to 17% Er, 2 to 15% Dy and 2 to 15% Tb, (b) 1 to 34% Ce or Ce misch metal in an amount corresponding to 1 to 34% Ce, (c) Sm, and (d) the balance consisting essentially of Co, wherein the amount of Sm is such that the total amount of rare earth elements in said product is 23 to 43%, and the absolute value of the reversible magnetization temperature coefficient of said sintered product is not more than 0.04%/° C in the temperature range of −50° C to 100° C.

4. A permanent magnet made of a sintered product consisting essentially of, in weight percent, (a) at least one of 3 to 18% Ho, 2 to 17% Er, 2 to 15% Dy and 2 to 15% Tb, (b) 3 to 20% Gd, (c) Sm, and (d) the balance consisting essentially of Co, wherein the amount of Sm is such that the total amount of rare earth elements in said product is in the range of 23 to 43%, and the absolute value of the reversible magnetization temperature coefficient of said sintered product is not more than 0.02%/° C in the temperature range of −50° C to 200° C.

5. A permanent magnet made of a sintered product consisting essentially of, in weight percent, (a) at least one of 3 to 18% Ho, 2 to 17% Er, 2 to 15% Dy and 2 to 15% Tb, (b) 3 to 20% Gd, (c) 4 to 33% Pr, (d) Sm, and (e) the balance consisting essentially of Co, wherein the amount of Sm is such that the total amount of rare earth elements in said product is in a range of 23 to 43%, and the absolute value of the reversible magnetization temperature coefficient of said sintered product is not more than 0.02%/° C in the temperature range of −50° to 200° C.

6. A permanent magnet made of a sintered product consisting essentially of, in weight percent, (a) at least one of 3 to 18% Ho, 2 to 17% Er, 2 to 15% Dy and 2 to 15% Tb, (b) 3 to 20% Gd (c) 1 to 34% Ce or Ce misch metal in an amount corresponding to 1 to 34% Ce, (d) Sm, and (e) the balance consisting essentially of Co, wherein the amount of Sm is such that the total amount of rare earth elements including Sm in said product is 23 to 43%, and the absolute value of the reversible magnetization temperature coefficient of said sintered product is not more than 0.03%/° C in the temperature range of −50° to 200° C.

7. A permanent magnet as set forth in claim 1, wherein said magnet contains 3 to 18% Ho.

8. A permanent magnet as set forth in claim 2, wherein said magnet contains 3 to 18% Ho.

9. A permanent magnet as set forth in claim 3, wherein said magnet contains 3 to 18% Ho.

10. A permanent magnet as set forth in claim 4, wherein said permanent magnet contains 3 to 18% Ho.

11. A permanent magnet as set forth in claim 5, wherein said magnet contains 3 to 18% Ho.

12. A permanent magnet as set forth in claim 6, wherein said magnet contains 3 to 18% Ho.

13. A permanent magnet as set forth in claim 1, wherein said sintered product consists of cobalt, samarium and at least one rare earth element selected from the group consisting of 18% Ho, 2 to 17% Er, 2 to 15% Dy and 2 to 15% Tb.

14. A permanent magnet as set forth in claim 2, wherein said sintered product consists of cobalt, samarium, 4 to 33% Pr and at least one member selected from the group consisting of 3 to 18% Ho, 2 to 17% Er, 2 to 15% Dy and 2 to 15% Tb.

15. A permanent magnet as set forth in claim 3, wherein said sintered product consists of cobalt, samarium, at least one member selected from the group consisting of 3 to 18% Ho, 2 to 17% Er, 2 to 15% Dy, and 2 to 15% Tb, and 1 to 34% Ce or Ce misch metal in an amount corresponding to 1 to 34% Ce.

16. A permanent magnet as set forth in claim 4, wherein said sintered product consists of at least one member selected from the group consisting of 3 to 18% Ho, 2 to 17% Er, 2 to 15% Dy and 2 to 15% Tb, 3 to 20% Gd, samarium and cobalt.

17. A permanent magnet as set forth in claim 5, wherein said sintered product consists of at least one member selected from the group consisting of 3 to 18% Ho, 2 to 17% Er, 2 to 15% Dy, and 2 to 15% Tb, 3 to 20% Gd, 4 to 33% Pr, Sm and Co.

18. A permanent magnet as set forth in claim 6, wherein said sintered product consists of at least one member selected from the group consisting of 3 to 18% Ho, 2 to 17% Er, 2 to 15% Dy and 2 to 15% Tb, 3 to 20% Gd, 1 to 34% Ce or Ce misch metal in an amount corresponding to 1 to 34% Ce, samarium and cobalt.

* * * * *